United States Patent [19]

Sato et al.

[11] 4,140,532

[45] Feb. 20, 1979

[54] THERMALLY DEVELOPABLE LIGHT-SENSITIVE MATERIAL

[75] Inventors: Hideo Sato; Nobuyoshi Sekikawa; Toshinao Ukai; Takao Masuda, all of Asaka, Japan

[73] Assignee: Fuji Photo Film Co., Ltd., Minami-ashigara, Japan

[21] Appl. No.: 860,652

[22] Filed: Dec. 14, 1977

[30] Foreign Application Priority Data

Dec. 17, 1976 [JP] Japan ..... 51/151634

[51] Int. Cl.[2] ..... G03C 1/02

[52] U.S. Cl. ..... 96/114.1; 96/48 HD; 96/76 R; 96/52

[58] Field of Search ..... 96/114.1, 76, 114.6, 96/67, 52; 544/50

[56] References Cited

U.S. PATENT DOCUMENTS

| | | | |
|---|---|---|---|
| 3,885,967 | 5/1975 | Sashihara et al. | 96/114.1 |
| 3,951,660 | 4/1976 | Hagemann et al. | 96/114.1 |

FOREIGN PATENT DOCUMENTS

| | | | |
|---|---|---|---|
| 232340 | 4/1959 | Australia | 544/50 |

*Primary Examiner*—Travis Brown

*Attorney, Agent, or Firm*—Sughrue, Rothwell, Mion, Zinn and Macpeak

[57] ABSTRACT

A thermally developable light-sensitive material comprising a support and containing at least (a) an organic silver salt, (b) a photocatalyst, (c) a reducing agent and (d) a color toning agent in the support or in at least one layer provided on the support, wherein the color toning agent is at least one 2H-1,3-benzothiazin-2,4(3H)-dione, e.g., having the following general formula (I):

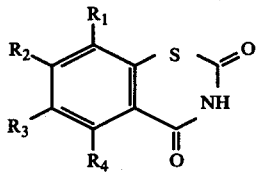

(I)

wherein $R_1$, $R_2$, $R_3$ and $R_4$, which may be the same or different, each represents a hydrogen atom, a halogen atom, an alkyl group, a cycloalkyl group, an aryl group, an alkoxy group, an aryloxy group, an alkylthio group, a hydroxy group, an acyloxy group, a nitro group, an amino group, an alkyl-substituted amino group, an aryl-substituted amino group, an acylamino group, an acyl group, a hydroxycarbonyl group, an alkoxycarbonyl group, an aryloxycarbonyl group, a sulfamoyl group, an alkyl-substituted sulfamoyl group, an aryl-substituted sulfamoyl group, an alkylsulfonyl group, an arylsulfonyl group or a sulfo group, further, $R_1$ and $R_2$, $R_2$ and $R_3$, and/or $R_3$ and $R_4$, may combine and represent the atoms necessary to form a condensed aromatic ring; and, further, one of $R_1$, $R_2$, $R_3$ and $R_4$ may be a monovalent residue of the general formula (I), in which the color toning effect is retained even under conditions of high temperature and/or high humidity.

33 Claims, No Drawings

THERMALLY DEVELOPABLE LIGHT-SENSITIVE MATERIAL

BACKGROUND OF THE INVENTION

1. Field of the Invention

The present invention relates to thermally developable light-sensitive materials and, more particularly, it is concerned with thermally developable light-sensitive materials containing a novel, improved color toning agent.

2. Description of the Prior Art

It is known that photographic materials containing a light-sensitive material such as silver halides can be used to produce images by heating, that is to say, using the socalled dry processing. The most promising light-sensitive materials that can be used to produce photographic inages using such a dry processing at the present time are thermally developable light-sensitive materials which utilize compositions capable of forming images in which an oxidation-reduction image forming composition comprising, as essential components, organic silver salt oxidizing agents (such as silver behenate), reducing agents and a small amount of a photocatalyst such as a light-sensitive silver halide, is utilized, e.g., as disclosed in U.S. Pat. Nos. 3,152,904, 3,457,075, 3,707,377, 3,909,271 and so on. Such light-sensitive materials are stable at ordinary temperatures, but when heated to a temperature higher than about 80° C. and preferably, higher than 100° C., after exposure to light through an original image, silver is produced by an oxidation-reduction reaction between the organic silver salt oxidizing agent and the reducing agent present in the light-sensitive layer due to the catalytic action of the exposed photocatalyst present in proximity thereto whereby the exposed areas of the light-sensitive layer rapidly blacken and a contrast between the blacked areas and unexposed areas (background) is produced. Thus, images are formed.

In this light-sensitive system, photocatalysts in the light-sensitive materials after the completion of development are allowed to remain without stabilization to light, even though they change color upon exposure to light. Nevertheless, this system can produce satisfactory results, just as in the case where the residual photocatalyst receives a certain stabilizing treatment for light. This is because only a small amount of photocatalyst is employed in the system and a large portion of the silver component is present in a form of white or slightly colored organic silver salts which blacken upon light-exposure with difficulty and, therefore, even if color change occurs due to the decomposition of a small amount of residual photocatalyst through exposure to light, such a slight color change is difficult to discern visually.

In many cases, yellowish-brown colored images are produced with the above-described thermally developable light-sensitive materials utilizing silver salt oxidizing agents. However, the addition of color toning agents thereto can improve the color tone and achieve a preferred black color tone. Examples of such color toning agents include phthalazinones, oxazinediones, cyclic imides, urazoles, imino compounds such as 2-pyrazoline-5-ones and mercapto compounds as disclosed in, for example, U.S. Pat. Nos. 3,846,136, 3,782,941, 3,844,797, 3,832,186, 3,881,938 and 3,885,967, British Patent No. 1,380,795, Japanese Patent Application (OPI) Nos. 151138/75, 91215/74, 67132/75, 67641/75, 114217/75, 32927/75 and 22431/76, Japanese Patent Application No. 16128/76 and so on. However, these known color toning agents have some weak points. For instance, phthalazinones which exhibit the best color toning effect have a marked tendency to sublime and some of them quickly lose their color toning ability with the lapse of time under high humidity conditions, although desired color toning effects immediately after the preparation are achieved. The sublimation inherent in phthalazinones is disadvantageous since the inside of the developing device is contaminated by the sublimed phthalazinones adhering to and accumulating on the inside walls of the device used. Further, phthalazinones generate an unpleasant smell which permeates the area during the developing process. The introduction of substituents into the condensed benzene nucleus of phthalazinone has been attempted with the intention of suppressing the subliming ability of phthalazinone, but another new disadvantage of slow thermal development occurs with the resulting phthalazinone derivatives. Therefore, a satisfactory solution of the above-described problem has not yet been achieved.

Also, oxazinediones (e.g., benzoxazinediones as disclosed in U.S. Pat. No. 3,855,967) and cyclic imides (that is, phthalimides, 2,4-thiazolidinediones, 4-cyclohexane-1,2-dicarboxyimides and glutarimides as disclosed in U.S. Pat. No. 3,846,136), which are other classes of typical color toning agents, only cause a color toning effect upon certain specific organic silver salts, and possess such an insufficient color toning effect, compared with that of phthalazinone, that only brown or yellow colored images are achieved even immediately after the preparation of thermally developable light-sensitive materials of the above-described kind.

SUMMARY OF THE INVENTION

Therefore, an object of the present invention is to provide a novel color toning agent free from the disadvantages which conventional color toning agents have.

Another object of the present invention is to provide thermally developable light-sensitive materials possessing an improved shelf life (i.e., the ability after storage of retaining the properties of freshly prepared materials).

The above-described objects are attained with a thermally developable light-sensitive material comprising a support and containing at least (a) an organic silver salt, (b) a photocatalyst, (c) a reducing agent and (d) at least one 2H-1,3-benzothiazin-2,4(3H)-dione as a color toning agent in the support or in at least one layer provided on the support.

DETAILED DESCRIPTION OF THE INVENTION

Preferred 2H-1,3-benzothiazin-2,4(3H)-diones described above for component (d) include 2H-1,3-benzothiazin-2,4(3H)-dione compounds represented by the following general formula (I):

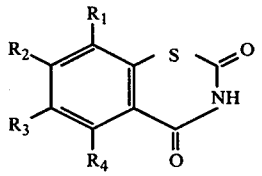

(I)

wherein $R_1$, $R_2$, $R_3$ and $R_4$, which may be the same or different, each represents a hydrogen atom, a halogen atom, an alkyl group, a cycloalkyl group, an aryl group, an alkoxy group, an aryloxy group, an alkylthio group, an arylthio group, a hydroxy group, an acyloxy group, a nitro group, an amino group, an alkyl-substituted amino group, an aryl-substituted amino group, an acylamino group, an acyl group, a hydroxycarbonyl group, an alkoxycarbonyl group, an aryloxycarbonyl group, a sulfamoyl group, an alkyl-substituted sulfamoyl group, an alkoxy-substituted sulfamoyl group, an aryl-substituted sulfamoyl group, an alkylsulfonyl group, an arylsulfonyl group or a sulfo group and, further, $R_1$ and $R_2$, $R_2$ and $R_3$ and/or $R_3$ and $R_4$ may combine and represent the atoms necessary to form a condensed aromatic ring.

These substituents as described above for $R_1$ to $R_4$ are illustrated below in greater detail. More specifically, $R_1$, $R_2$, $R_3$ and $R_4$ each represents the following atoms, groups and atomic groupings.

(1) Hydrogen atom;

(2) Halogen atoms, e.g., fluorine, chlorine, bromine and iodine;

(3) Alkyl groups, preferably, straight chain or branched chain alkyl groups which contain 1 to 20 carbon atoms (e.g., methyl, ethyl, propyl, isopropyl, butyl, t-butyl, hexyl, nonyl, dodecyl, octadecyl, eicosyl and the like) and more particularly, those which contain 1 to 4 carbon atoms;

(4) Cycloalkyl groups, preferably, those which contain 5 to 8 carbon atoms (e.g., cyclopentyl, cyclohexyl and the like);

(5) Aryl groups, preferably, those which contain 6 to 14 carbon atoms (e.g., phenyl, naphthyl and the like);

(6) Alkoxy groups, preferably, those which contain a straight chain, branched chain or cyclic alkyl moiety, and which contain 1 to 12 carbon atoms (e.g., methoxy, ethoxy, propoxy, isopropoxy, butoxy, t-butoxy, hexyloxy, nonyloxy, dodecyloxy, cyclopentyloxy and cyclohexyloxy) and more particularly, those which contain 1 to 4 carbon atoms;

(7) Aryloxy groups, preferably, those which contain 6 to 14 carbon atoms (e.g., phenoxy, naphthoxy and the like);

(8) Alkylthio groups, preferably, those which contain a straight chain, branched chain or cyclic alkyl moiety, and which contain 1 to 20 carbon atoms (e.g., methylthio, ethylthio, propylthio, isopropylthio, butylthio, t-butylthio, hexylthio, nonylthio, dodecylthio, octadecylthio, eicosylthio, cyclopentylthio, cyclohexylthio and the like) and more particularly, those which contain 1 to 4 carbon atoms;

(9) Arylthio groups, preferably, those which contain 6 to 14 carbon atoms (e.g., phenylthio, naphthylthio and the like);

(10) Hydroxy group;

(11) Acyloxy groups, preferably, those which contain alkyl moieties with 1 to 20 carbon atoms, alkenyl moieties with 2 to 20 carbon atoms or aryl moieties with 6 to 14 carbon atoms (e.g., formyloxy, acetyloxy, propionyloxy, butyryloxy, valeryloxy, palmitoyloxy, stearoyloxy, oleoyloxy, acryloyloxy, propioloyloxy, benzoyloxy, naphthoyloxy and the like) and more particularly, those which contain alkyl moieties with 1 to 4 carbon atoms and a benzoyloxy group;

(12) Nitro group;

(13) Amino group ($-NH_2$);

(14) Alkyl-substituted amino groups, preferably, amino groups in which one or two hydrogens thereof are replaced by one or two straight chain, branched chain or cyclic alkyl groups containing 1 to 12 carbon atoms (e.g., methylamino, dimethylamino, ethylamino, diethylamino, propylamino, di-(t-butyl)amino, octylamino, docecylamino, cyclopentylamino, cyclohexylamino and the like) and more particularly, amino groups with one or two alkyl substituents containing 1 to 4 carbon atoms;

(15) Aryl-substituted amino groups, preferably, amino groups in which one or two hydrogen atoms thereof are replaced by one or two aryl groups having 6 to 14 carbon atoms such as phenyl and naphthyl groups (e.g., phenylamino, diphenylamino, naphthylamino and the like);

(16) Acylamino groups, preferably, amino groups in which one or two hydrogen atoms thereof are replaced by one or two acyl groups, respectively, with alkyl moieties containing 1 to 20 carbon atoms, with alkenyl moieties containing 2 to 20 carbon atoms or aryl moieties containing 6 to 14 carbon atoms (e.g., acetylamino, diacetylamino, propionylamino, butyrylamino, (t)-butyrylamino, acrylamino, propioloylamino, oleoylamino, benzoylamino and the like);

(17) Acyl groups, preferably, those which have an alkyl moiety containing 1 to 11 carbon atoms, an alkenyl moiety containing 2 to 20 carbon atoms or an aryl moiety containing 6 to 14 carbon atoms (e.g., formyl, acetyl, propionyl, butyryl, valeryl, isocrotonoyl, octanoyl, benzoyl, naphthoyl and the like) and more particularly, those which have an alkyl moeity containing 1 to 4 carbon atoms or a phenyl group;

(18) Hydroxycarbonyl group;

(19) Alkoxycarbonyl groups, preferably, those which have straight chain, branched chain or cyclic alkoxy moieties containing 1 to 20 carbon atoms (e.g., methoxycarbonyl, ethoxycarbonyl, propoxycarbonyl, butoxycarbonyl, octyloxycarbonyl, dodecyloxycarbonyl, octadecyloxycarbonyl, eicosyloxycarbonyl and the like) and more particularly, those which have alkoxy moieties containing 1 to 4 carbon atoms;

(20) Aryloxycarbonyl groups, preferably, those which have aryl moieties having 6 to 14 carbon atoms (e.g., phenoxycarbonyl, naphthoxycarbonyl and the like);

(21) Sulfamoyl group;

(22) Alkyl-substituted sulfamoyl groups, preferably, sulfamoyl groups having one or two straight chain, branched chain or cyclic alkyl moieties containing 1 to 12 carbon atoms (e.g., methylsulfamoyl, dimethylsulfamoyl, ethylsulfamoyl, butylsulfamoyl, nonylsulfamoyl, dodecylsulfamoyl and the like) and more particularly, those which have alkyl groups containing 1 to 4 carbon atoms;

(23) Alkoxy-substituted sulfamoyl groups, preferably, sulfamoyl groups having one or two straight chain, branched chain or cyclic alkoxy moieties containing 1 to 12 carbon atoms (e.g., methoxysulfamoyl, dimethoxysulfamoyl, ethoxysulfamoyl, butoxysulfamoyl and the like) and more particularly, those which have alkoxy moieties containing 1 to 4 carbon atoms;

(24) Aryl-substituted sulfamoyl groups, those which have aryl moieties containing 6 to 14 carbon atoms (e.g., phenylsulfamoyl, diphenylsulfamoyl and the like);

(25) Alkylsulfonyl groups, preferably, sulfonyl groups having straight chain, branched chain or cyclic alkyl moieties containing 1 to 20 carbon atoms (e.g., methylsulfonyl, ethylsulfonyl, propylsulfonyl, butylsulfonyl, octylsulfonyl, decylsulfonyl, octadecylsulfonyl, eicosylsulfonyl and the like) and more particularly, sulfonyl groups having alkyl moieties containing 1 to 4 carbon atoms, and aralkylsulfonyl groups having alkyl moieties containing 1 to 4 carbon atoms in which the hydrogen thereof is replaced by aryl groups hereinafter described, such as phenyl and the like (e.g., benzylsulfonyl, α,α-dimethyl-benzylsulfonyl and the like);

(26) Arylsulfonyl groups, preferably, sulfonyl groups having aryl moieties containing 6 to 14 carbon atoms (e.g., phenylsulfonyl, naphthylsulfonyl); and

(27) Sulfo group (—$SO_3H$).

The above-described groups (3) to (9), (11), (14) to (17), (19), (20) and (22) to (26) may be additionally substituted with one or more of the following substituents. Examples of such substituents include (i) halogen atoms (i.e., F, Cl. Br and I); (ii) a nitro group; (iii) alkoxy groups containing 1 to 5 carbon atoms (e.g., methoxy, ethoxy, butoxy, etc.); (iv) acyl groups containing 1 to 5 carbon atoms (e.g., acetyl, butyryl, pivaloyl, etc.); (v) acyloxy groups containing 2 to 5 carbon atoms (e.g., acetoxy, butyryloxy, etc.); (vi) a carboxy group; (vii) alkoxycarbonyl groups containing 2 to 5 carbon atoms (e.g., methoxycarbonyl, ethoxycarbonyl; etc.); (viii) aryl groups containing 6 to 14 carbon atoms (e.g., phenyl, naphthyl, anthracenyl, and like groups which may be further substituted with one or more halogen atoms, alkyl groups having 1 to 4 carbon atoms or alkoxy groups having 1 to 4 carbon atoms); and (ix) aryloxy groups containing 6 to 14 carbon atoms which may be further substituted with one or more halogen atoms, alkyl groups having 1 to 4 carbon atoms, alkoxy groups having 1 to 4 carbon atoms and so on.

In addition, a preferred aromatic ring formed by the combination of $R_1$ and $R_2$, $R_2$ and $R_3$, and/or $R_3$ and $R_4$ is a benzene ring.

2H-1,3-benzothiazin-2,4(3H)-diones in which the substituents corresponding to $R_1$, $R_2$, $R_3$ and/or $R_4$ are the substituents (1), (2), (3), (4), (5), (6), (7), (8), (9), (10), (11), (12), (16), (17), (19), (20), (21), (22), (23), (24), (25) and/or (26) are particularly preferred, since these compounds possess an efficient color toning ability and because these compounds suppress the occurrence of fog.

In addition, at least one of $R_1$, $R_2$, $R_3$ and $R_4$ may be replaced by a 1,3-benzothiazin-2,4(3H)-dione group, ie., a dimer being formed.

Specific examples of 2H-1,3-benzothiazin-2,4(3H)-diones of the general formula (I) above useful as component (d) in the present invention are illustrated below:

( 1) 2H-1,3-Benzothiazin-2,4(3H)-dione
( 2) 8-Chloro-2H-1,3-benzothiazin-2,4(3H)-dione
( 3) 6,8-Dichloro-2H-1,3-benzothiazin-2,4(3H)-dione
( 4) 6-Chloro-8-bromo-2H-1,3-benzothiazin-2,4(3H)-dione
( 5) 6-Bromo-2H-1,3-benzothiazin-2,4(3H)-dione
( 6) 6,8-Dibromo-2H-1,3-benzothiazin-2,4(3H)-dione
( 7) 6-Iodo-2H-1,3-benzothiazin-2,4(3H)-dione
( 8) 6,8-Diiodo-2H-1,3-benzothiazin-2,4(3H)-dione
( 9) 6-Fluoro-2H-1,3-benzothiazin-2,4(3H)-dione
(10) 6-Methyl-2H-1,3-benzothiazin-2,4(3H)-dione
(11) 6-Ethyl-2H-1,3-benzothiazin-2,4(3H)-dione
(12) 8-Methyl-2H-1,3-benzothiazin-2,4(3H)-dione
(13) 8-Ethyl-2H-1,3-benzothiazin-2,4(3H)-dione
(14) 6,7-Dimethyl-2H-1,3-benzothiazin-2,4(3H)-dione
(15) 6-(t)-Butyl-2H-1,3-benzothiazin-2,4(3H)-dione
(16) 6,8-Di-(t)-butyl-2H-1,3-benzothiazin-2,4(3H)-dione
(17) 6-Benzyl-2H-1,3-benzothiazin-2,4(3H)-dione
(18) 6-(α,α-Dimethylbenzyl)-2H-1,3-benzothiazin-2,4(3H)-dione
(19) 6-Cyclohexyl-2H-1,3-benzothiazin-2,4(3H)-dione
(20) 6-Phenyl-2H-1,3-benzothiazin-2,4(3H)-dione
(21) 6-(2-Hydroxy-4-methoxy)phenyl-2H-1,3-benzothiazin-2,4(3H)-dione
(22) 7-Methoxy-2H-1,3-benzothiazin-2,4(3H)-dione
(23) 7-Phenoxy-2H-1,3-benzothiazin-2,4(3H)-dione
(24) 6-Methylthio-2H-1,3-benzothiazin-2,4(3H)-dione
(25) 6-Methylthio-7-methyl-2H-1,3-benzothiazin-2,4(3H)-dione
(26) 6-Phenylthio-2H-1,3-benzothiazin-2,4(3H)-dione
(27) 7-Hydroxy-2H-1,3-benzothiazin-2,4(3H)-dione
(28) 7-Acetyloxy-2H-1,3-benzothiazin-2,4(3H)-dione
(29) 6,7-bis(Benzyloxy)-2H-1,3-benzothiazin-2,4(3H)-dione
(30) 6-Nitro-2H-1,3-benzothiazin-2,4(3H)-dione
(31) 6,8-Dinitro-2H-1,3-benzothiazin-2,4(3H)-dione
(32) 6-Amino-2H-1,3-benzothiazin-2,4(3H)-dione
(33) 6-Methylamino-2H-1,3-benzothiazin-2,4(3H)-dione
(34) 6-Dimethylamino-2H-1,3-benzothiazin-2,4(3H)-dione
(35) 6,8-bis(Dimethylamino)-2H-1,3-benzothiazin-2,4(3H)-dione
(36) 6-Phenylamino-2H-1,3-benzothiazin-2,4(3H)-dione
(37) 6-Diphenylamino-2H-1,3-benzothiazin-2,4(3H)-dione
(38) 6-Acetylamino-2H-1,3-benzothiazin-2,4(3H)-dione
(39) 6-Acetyl-2H-1,3-benzothiazin-2,4(3H)-dione
(40) 6-Benzoyl-2H-1,3-benzothiazin-2,4(3H)-dione
(41) 6-(2,4-Dihydroxyphenyl)carbonyl-2H-1,3-benzothiazin-2,4(3H)-dione
(42) 6-Carboxy-2H-1,3-benzothiazin-2,4(3H)-dione
(43) 6-Ethoxycarbonyl-2H-1,3-benzothiazin-2,4(3H)-dione (44) 6-Phenoxycarbonyl-2H-1,3-benzothiazin-2,4(3H)-dione
(45) 6-Methylsulfamoyl-7-chloro-2H-1,3-benzothiazin-2,4(3H)-dione
(46) 6-Phenylsulfamoyl-7-chloro-2H-1,3-benzothiazin-2,4(3H)-dione
(47) 6-Benzylsulfonyl-2H-1,3-benzothiazin-2,4(3H)-dione
(48) 6-Methylsulfonyl-2H-1,3-benzothiazin-2,4(3H)-dione (49) 6-Sulfo-2H-1,3-benzothiazin-2,4(3H)-dione
(50) 4H-Naphtho[2,3-e]-1,3-thiazin-2,4-dione Of these compounds, compounds (1) to (10), (12), (14), (15), (16), (20), (24) to (26), (30), (31) and (38) to (48) are particularly preferred compounds.

2H-1,3-Benzothiazin-2,4(3H)-diones, component (d) of the present invention, are known compounds and can be easily synthesized in a conventional manner by one skilled in the art.

For instance, in accordance with the method described in U.S. Pat. No. 2,978,448 and German Patent No. 1,105,874, 2H-1,3-benzothiazin-2,4(3H)-diones of the general formula (I) can be prepared by the reaction of o-mercaptobenzoic acids (A), ammonia and chloroformic acid esters in the presence of a certain base, as is represented by the following reaction schematic:

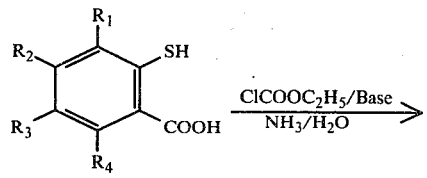

(A)

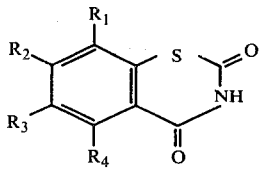

(I)

Also, as described in U.S. Pat. No. 2,978,448 and German Patent No. 1,105,874, the compounds of the general formula (I) can be prepared by reacting o-mercaptobenzoic acid amides (thiosalicylic acid amides) (B) with phosgene or the like, as is represented by the following reaction schematic:

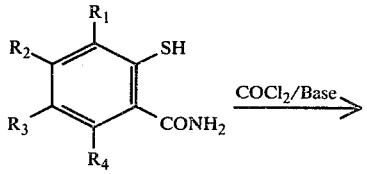

(B)

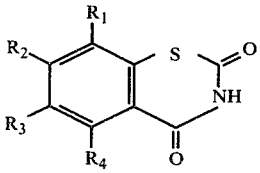

(I)

In both of the above reaction schematics, $R_1$, $R_2$, $R_3$ and $R_4$ each has the same meaning as described above.

o-Mercaptobenzoic acids (A) or o-mercaptobenzoic acid amides (B), with various kinds of substituents, can be easily synthesized using various known techniques, e.g., as described in L. Katz et al., *J. Org. Chem.*, Vol. 18, 1380 (1953); N. M. Shchukina et al., *Zhur. Obshchec Khim.*, Vol. 22, 1855 (1952); F. Giald et al., *Farmaco (Pavia) Ed. Sci.*, Vol. 14, 216 (1959); and so on.

Examples of processes for preparing each of the starting materials described above is illustrated below. Unless otherwise indicated herein, all parts, percents, ratios and the like are by weight.

Preparation of 5-Chloro-o-mercaptobenzoic Acid 94 g of 5-chloroanthranilic acid (0.545 mol), 23 g of sodium hydroxide (0.55 mol) and 37.5 g of sodium nitrite (0.545 mol) were dissolved in 650 ml of water. The resulting solution was slowly added dropwise to a mixture of 150 ml of conc. hydrochloric acid (12N) and 200 g of ice which was put in a container equipped with a stirrer and immersed in an ice bath. The reaction mixture was maintained at a temperature of 0 to 5° C. during the dropwise addition by adding ice as required thereto. After the conclusion of the dropwise addition, stirring was further continued for 30 minutes. Then, the reaction mixture was neutralized to a pH of 10 with sodium acetate. The thus-obtained cooled diazonium solution was poured into an aqueous solution of potassium ethylxanthogenate (containing 250 g of

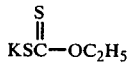

(corresponding to 1.55 mol) and 800 ml of water) previously heated to 75 to 80° C., and the temperature of the reaction system was kept at 75 to 80° C. Then, the reaction system was cooled and adjusted to a pH of 3 using conc. hydrochloric acid (12N) to result in the production of a sludge.

The water containing sludge obtained by removing water by decantation was dissolved in 400 ml of a 10% aqueous solution of sodium hydroxide and then, heated (80 - 90° C.) on a steam bath for 2 hours.

Next, 50 g of NaHS was added thereto and the reaction system was heated at a temperature of 80 - 90° C. for 10 minutes. After cooling, the reaction system was adjusted to a pH of 4 to 5 using conc. hydrochloric acid (12N) to result in the deposition of a solid. The solid was filtered off, and washed with water. The resulting wet solid was dissolved or dispersed into 80 ml of methanol, to which 1.5 liter of di-isopropyl ether was added and an aqueous phase was separated. The ether phase was dried by the addition of anhydrous magnesium sulfate. Then, the solvent used was removed therefrom to obtain 88 g of product, i.e., 5-chloro-o-mercaptobenzoic acid. The yield was 85% and the melting point was 192 - 194° C.

By the use of the thus-obtained o-mercaptobenzoic acids or o-mercaptobenzoic acid amides, the corresponding 2H-1,3-benzothiazin-2,4(3H)-diones can be synthesized using one of the above-described methods. An example of such a synthesis for 2H-1,3-benzothiazin-2,4(3H)-diones is described below:

Preparation of 2H-1,3-Benzothiazin-2,4(3H)-dione 30 g of thiosalicylic acid and 39 g of triethylamine were dissolved in 125 ml of tetrahydrofuran. The mixed solution was maintained at a temperature of 0 - 5° C., to which 42 g of ethyl chloroformate was added dropwise. The system was allowed to stand for 30 minutes and then, 50 ml of aqueous ammonia (ammonia concentration: 25 - 30%) was added thereto. The resulting solution was allowed to stand over night at room temperatue (about 20 - 30° C.). Then, the solvent used was removed by distillation under reduced pressure, while the residue was filtered off, and recrystallized from ethanol. 21 g of 2H-1,3-benzothiazin-2,4(3H)-dione was obtained. The melting point of the product was 210 - 211° C. (In addition, this product can be also prepared by using as a starting material the ester derivatives of thiosalicylic acid, which are obtained using usual esterification reactions, in a similar manner as above.)

The melting points of some representative examples of thus-obtained 2H-1,3-benzothiazin-2,4(3H)-diones are set forth below:

6-Methyl-2H-1,3-benzothiazin-2,4(3H)-dione; m.p. 184° C.

6-Bromo-2H-1,3-benzothiazin-2,4(3H)-dione: m.p. 218° C.

6,8-Dibromo-2H-1,3-benzothiazin-2,4(3H)-dione: m.p. 219 - 220° C.

6-tert-Butyl-2H-1,3-benzothiazin-2,4(3H)-dione: m.p. 178° C.

Component (d), the color toning agent, is used in an amount of preferably about $10^{-4}$ mol to about 10 mol and, more particularly, about 0.01 to about 2 mol, per mol of component (a), the organic silver salt.

Known color toning agents can auxiliarily be used in combination with the color toning agent of the present invention. Examples of auxiliary color toning agents include not only phthalazinone as disclosed in, for example, U.S. Pat. No. 3,080,254; phthalazinone derivatives as disclosed in, for example, Japanese Patent Application (OPI) Nos. 117026/74 and 67132/75; and benzoxazinediones as disclosed in, for example, U.S. Pat. No. 3,951,660; but also phthalimides, succinimides and 2,4-thiazolidinediones as disclosed in U.S. Pat. No. 3,846,136. Particularly, combinations of component (d) of the present invention with known halogen substituted color toning agents, such as 6-bromo-1,3-benzoxazin-2,4(3H)-dione, 7-bromo-1,3-benzoxazin-2,4(3H)-dione, 4-bromo-phthalimide and so on, are preferred. These auxiliary color toning agents can be employed in amounts of preferably, less than about 50 mol and, more particularly, less than 20 mol, per mol of component (d) of the present invention. When auxiliary color toning agents are used in amounts above about 50 mol per mol of component (d), the effect aimed in the present invention is depressed.

The organic silver salts used as component (a) of the present invention are colorless, white or slightly colored silver salts and are capable of producing silver (a silver image) by reacting with an appropriate reducing agent in the presence of a photocatalyst, such as exposed silver halide when heated to a temperature higher than about 80° C. and, preferably higher than 100° C. Examples of such organic silver salts include, generally, silver salts of organic compounds containing an imino group, a mercapto group or a thione group or a carboxyl group. Specific examples of these organic silver salts are illustrated in detail below.

(1) Silver salts of imino group-containing organic compounds as disclosed in Japanese Patent Application (OPI) No. 22431/76, such as silver benzotriazoles, silver saccharin, silver phthalazinones, silver phthalimides and so on.

(2) Silver salts of mercapto or thione group-containing organic compounds as disclosed in, e.g., Japanese Patent Application (OPI) No. 22431/76, U.S. Patent 3,933,507, and U.S. Pat. No. 3,785,830, such as silver 2-mercaptobenzoxazole, silver mercaptoxadiazole, silver 2-mercaptobenzothiazole, silver 2-mercaptobenzimidazole, silver 3-mercapto-4-phenyl-1,2,4-triazole and so on.

(3) Carboxyl group-containing organic silver salts including (a) silver salts of aliphatic carboxylic acids as disclosed in. e.g., Japanese Patent Application (OPI) No. 22431/76, U.S. Patent 3,457,075 and Japanese Patent Application (OPI) No. 99719/75, for example, silver laurate, silver myristate, silver palmitate, silver stearate, silver arachidonate, silver behenate, silver salts of aliphatic carboxylic acids containing 23 or more carbon atoms, silver adipate, silver sebacate, silver hydroxystearate and so on; (b) silver salts of aromatic carboxylic acids as disclosed in, e.g., Japanese Patent Application (OPI) Nos. 22431/76 and 99719/75, for example, silver benzoate, silver phthalate, silver phenylacetate, silver 4'-n-octadecyloxydiphenyl-4-carboxylate and the like; and so on.

(4) Other silver salts as disclosed in e.g., Japanese Patent Application (OPI) Nos. 22431/76 and 93139/75, such as silver 4-hydroxy-6-methyl-1,3,3*a*,7-tetrazaindene, silver 5-methyl-7-hydroxy-1,2,3,4,t-pentazaindene and so on.

Of the above-described organic silver salts, those which have a comparatively high stability to light are suitable for use when silver halides or silver-dye complexes are employed as a photocatalyst, component (b). Preferred examples of such organic silver salts include the silver salts of long chain aliphatic carboxylic acids containing preferably 10 to 40 carbon atoms and, more particularly, 12 to 33 carbon atoms, which are represented by the formula: $CH_3(CH_2)_nCOOAg$ (n: 10 to 31), and combinations thereof.

The organic silver salt, component (a), is used in such an amount that the coverage of silver ranges from about 0.1 g to about 4 g, and preferably from about 0.2 g to about 2.5 g, per square meter of the support (hereinafter described). When the organic silver salt is present in an amount less than about 0.1 g/m$^2$, the density of the image obtained is too low, while when the organic silver salt is present in an amount in excess of about 4 g/m$^2$, the preparation of the corresponding light-sensitive material becomes expensive, since no increase in image density is observed with the increase in the amount of silver used.

The organic silver salts can be produced using various known techniques, e.g., as disclosed in U.S. Pat. Nos. 3,457,075, 3,458,544, 3,700,458 and 3,839,049, British Patents 1,405,867 and 1,173,426, Japanese Patent Application (OPI) No. 22431/76 and Japanese Patent Application 45997/75.

These techniques are summarized below. More specifically, an organic silver salt-forming agent (e.g., an imino compound, a carboxylic acid, a mercapto compound and a salt thereof) is dissolved or dispersed into an appropriate solvent (e.g., water, an aliphatic hydrocarbon, an ester, a ketone, a halogenated hydrocarbon, an ether, an aromatic hydrocarbon, an alcohol or an oil) to form Liquid A. A silver salt capable of producing an organic silver salt (e.g., silver nitrate, silver trifluoroacetate, silver tetrafluoroborate, and silver perchlorate) is dissolved or dispersed into an appropriate solvent (e.g., water, an alcohol, an acid amide, an amine, aqueous ammonia, a ketone, acetonitrile, dimethyl sulfoxide, an aromatic hydrocarbon, pyridine, an aliphatic hydrocarbon or the like) to form Liquid B. Then, Liquids A and B are mixed to prepare the corresponding organic silver salt.

Specific examples of the above-described solvents which can be used include toluene, xylene, water, cyclohexane, cyclohexene, dodecene, pentane, hexane, heptane, butyl acetate, amyl acetate, pentyl acetate, tricresyl phosphate, castor oil, methyl alcohol, ethyl alcohol, propyl alcohol, butyl alcohol, acetone, dioxane, methyl ethyl ketone, methyl isobutyl ketone, methylene chloride, dibutyl phthalate, dimethylformamide, ammonia, acetonitrile and so on. However, the invention is not intended to be construed as being limited to these examples.

The organic silver salt-forming reaction is carried out at an optional temperature within the range of about −80° C. to about 100° C., and preferably about −20° C. to about 70° C. A preferred reaction time ranges from about 0.01 second to about 150 hours, and more particularly from about 0.1 second to about 72 hours. The reaction is carried out at an optional pressure within the range of about $10^{-2}$ mm Hg to about 300 atmospheres of pressure, and preferably at atmospheric pressure. Both Liquids A and B are used in concentrations ranging from about $10^{-2}$ wt% to about $10^{2}$ wt% and, usually from about 1 wt% to about 50 wt%.

Ultrasonic waves may be applied to the reaction system during the organic silver salt-formation, as disclosed in British Patent No. 1,408,123.

In addition, in order to vary the form and/or the size of the organic silver salts obtained, and/or the photographic characteristics of light-sensitive material such as thermal stability, optical stability, sensitivity to light, fog and so on, polymers, metal-containing compounds and surface active agents may also be present with the organic silver salt-forming components during the preparation of the organic silver salt. An example of such a polymer is polyvinyl butyral as disclosed in U.S. Pat. No. 3,700,458 and Japanese Patent Application No. 133692/75. Examples of metals present in the above-described metal-containing compounds include not only mercury, lead, chromium, cobalt and rhodium, as disclosed in British Patent No. 1,378,734, Japanese Patent Application (OPI) Nos. 22430/76, 116024/75 and 134421/75, but also manganese, nickel, iron and cerium. The surface active agents and polymers each are employed in amounts ranging from about 0.1 g to about 1,000 g and, preferably about 1 g to about 500 g, per mol of the organic silver salt. The metal-containing compound is employed in an amount ranging from about $10^{-6}$ mol to about $10^{-1}$ mol per mol of the organic silver salt and in an amount ranging from about $10^{-5}$ mol to about $10^{-2}$ mol per mol of silver halide.

A preferred grain size for the thus-obtained organic silver salt ranges from about 10 microns to about 0.01 micron and, more particularly, about 5 microns to about 0.1 micron, in length.

Photocatalysts as component (b) of the present invention possess high sensitivity to light and have the ability to catalyze the redox reaction for image-formation between the organic silver salt, component (a), and the reducing agent, component (c), under heating after exposure to light.

A preferred example of a photocatalyst, component (b), for use in the present invention is a light-sensitive silver halide such as silver chloride, silver bromide, silver iodide, silver chlorobromoiodide, silver chlorobromide, silver chloroiodide, silver iodobromide and mixtures thereof. The photocatalyst, component (b), is employed in an amount ranging from about 0.001 mol to about 0.7 mol and, preferably from about 0.01 mol to about 0.5 mol, per mol of the organic silver salt, component (a). A preferred grain size for the silver halide ranges from about 2 microns to about 0.001 micron and, more particularly, from about 0.5 micron to about 0.01 micron, in length.

The light-sensitive silver halide can be prepared in the form of an emulsion using various methods well-known in the photographic art, such as the single jet method, the double jet method and so on. Specific examples of these emulsions include a Lippmann emulsion, an ammonia process emulsion, a thiocyanate or thioether ripened emulsion and so on. Light-sensitive silver halides which have been previously prepared using one of the above-described techniques are mixed with the redox composition comprising the organic silver salt and the reducing agent, as disclosed in U.S. Pat. No. 3,152,904.

Various approaches to achieve sufficient contact of the silver halide with the organic silver salts are known. One approach involves the addition of surface active agents to the reaction system, as disclosed in U.S. Pat. No. 3,761,273, Japanese Patent Application (OPI) No. 32926/75 or 32928/75. Another approach comprises preparing the light-sensitive silver halide in a polymer medium, with the silver halide being mixed with the organic silver salt as disclosed in, for example, U.S. Pat. Nos. 3,706,565, 3,706,564 and 3,713,833 and British Pat. No. 1,362,970. A further approach comprises decomposition of a silver halide emulsion using an appropriate enzyme and mixing the decomposed emulsion with the organic silver salt as disclosed in British Patent No. 1,354,186.

Silver halides which are prepared together with organic silver salts at substantially the same time as disclosed in, for example, Japanese Patent Application (OPI) No. 17216/75, can also be used in the present invention.

A still another approach is disclosed in U.S. Pat. No. 3,457,075, wherein a component which forms a light-sensitive silver halide (hereinafter described) is allowed to react with a previously prepared solution or dispersion of an organic silver salt, or to act upon a sheet material containing an organic silver salt. This results in the conversion of a portion of the organic silver salt component into the corresponding portion of the light-sensitive silver halide. The thus-obtained light-sensitive silver halide is in efficient contact with the organic silver salt and, therefore, exert advantageous effects upon the redox system.

Examples of light-sensitive silver halide-forming components which can be used include all compounds which can produce silver halides upon reaction with organic silver salts. Which compounds can be used and are effective can be easily determined. Namely, samples prepared by allowing the light-sensitive silver halide-forming components being tested to react with the organic silver salts and, optionally, by heating the resulting products, can be examined using X-ray diffraction techniques to determine whether diffraction peaks characteristic of silver halide are present or not.

Silver halides can be suitably formed under the following conditions of a temperature within the range of about −80 to about 100° C. and, preferably, about −20 to about 70° C., a reaction time within the range of about 0.01 second to about 150 hours and, preferably, about 0.1 second to about 72 hours, and under a pressure of about $10^{-2}$ mm Hg to about 300 atmospheres and, preferably, at atmospheric pressure.

Examples of components capable of forming light-sensitive silver halides upon reaction with the organic silver salts include inorganic halides, halogen-containing metal complexes, onium halides, halogenated hydrocarbons, N-halo compounds and other halogen-containing compounds. Specific examples of these compounds are described in detail in Japanese Patent Application (OPI) No. 22431/76, U.S. Pat. No. 3,457,075, Japanese Patent Application (OPI) No. 78316/75, Japanese Patent Application (OPI) No. 115027/75 and Japanese Patent Application (OPI) No. 9813/76. Specific classes and examples of these halogen-containing compounds are illustrated hereinafter in a greater detail.

(a) Inorganic halides, e.g., represented by the formula:

$MX_n$ wherein M represents H, $NH_4$ or a metal atom, X represents Cl, Br or I, and n is 1 when M is H or $NH_4$, or the valence of M when M is a metal atom. Specific examples of metals M in such halides include lithium, sodium, potassium, rubidium, cesium, copper, gold, beryllium, magnesium, calcium, strontium, barium, zinc, cadmium, mercuru, aluminum, gallium, indium, lanthanum, ruthenium, thallium, germanium, tin, lead, antimony, bismuth, chromium, molybdenum, tungsten, manganese, rhenium, iron, cobalt, nickel, ruthenium, rhodium, palladium, osmium, iridium, platinum, cerium and so on.

(b) Halogen-containing metal complexes, specific examples of which include $K_2PtCl_6$, $K_2PtBr_6$, $HAuCl_4$, $(NH_4)_2IrCl_6$, $(NH_4)_3IrCl_6$, $(NH_4)_2RuCl_6$, $(NH_4)_3RuCl_6$, $(NH_4)_2RhCl_6$, $(NH_4)_3RhBr_6$ and so on.

(c) Onium halides, specific examples of which include trimethylphenylammonium bromide, cetylethyldimethylammonium bromide, trimethylbenzylammonium bromide and other quaternary ammonium halides; quaternary phosphonium halides such as tetraethylphosphonium bromide; tertiary sulfonium halides such as trimethylsulfonium iodide; and so on.

(d) Halogenated hydrocarbons, specific examples of which include iodoform, bromoform, carbon tetrabromide, 2-bromo-2-methylpropane and so on.

(e) N-halo compounds, specific examples of which include N-chlorosuccinimide, N-bromosuccinimide, N-bromophthalimide, N-bromoacetamide, N-iodosuccinimide, N-bromophthalazone, N-bromooxazolinone, N-chlorophthalazone, N-bromoacetaniride N,N-dibromobenzenesulfonamide, N-bromo-N-methylbenzenesulfonamide, 1,3-dibromo-4,4-dimethylhydantoin, trichloroisocyanuric acid and so on.

(f) Other halogen-containing compounds such as triphenylmethyl chloride, triphenylmethyl bromide, 2-bromobutyric acid, 2-bromoethanol, benzophenone dichloride, triphenyl bromide and so on.

In the above-described processes, the silver halide-forming components can be used individually or as a combination thereof. A suitable amount of the silver halide-forming component ranges from about 0.001 mol to about 0.7 mol, and preferably about 0.01 mol to about 0.5 mol, per mol of the organic silver salt used as component (a). Use of an amount less than about 0.001 mol results in a low sensitivity, while use of a larger amount than about 0.7 mol causes an undesirable coloration in the background of the processed light-sensitive material when the material is allowed to stand for a long time, as they are, exposed to normal room illumination.

The silver halide prepared using any of the above-described techniques can be sensitized with sulfur-containing compounds, gold compounds, platinum compounds, palladium compounds, silver compounds, tin compounds or combinations thereof, e.g., as disclosed in, for example, Japanese Patent Applications 115386/74, 122902/74, 143178/74, 13074/75, 45646/75 and 81181/75.

Other photocatalysts can be also employed instead of silver halides. For instance, light-sensitive complexes prepared from silver salts and dyes as disclosed in Japanese Patent Publication 25498/74 and Japanese Patent Application (OPI) Nos. 4728/71 and 28221/73 can be employed as a photocatalyst. Also, combinations of highly light-sensitive organic silver salts with other organic silver salts having a comparatively low sensitivity can be used to achieve a similar effect to that of a photocatalyst, as disclosed in Japanese Patent Application (OPI) No. 8522/75. In addition, metal diazosulfonates and sulfinates can be employed as a photocatalyst, as disclosed in U.S. Pat. No. 3,152,904. Further, photoconductive materials such as zinc oxide, titanium oxide and the like can be employed for this purpose. However, the most preferred photocatalysts are silver halides and silver halide-forming components when highly sensitive thermally developable light-sensitive materials are required.

Moreover, some optical sensitizing dyes which are effective for gelatin-silver halide emulsions can also be used to achieve a sensitizing effect with the thermally developable light-sensitive materials of the present invention. Examples of effective, optical sensitizing dyes include cyanine, merocyanine, rhodacyanine, complex (tri- or tetra-nuclear) cyanine or merocyanine, holopolar cyanine, styryl, hemicyanine, oxonol, hemioxonol and xanthene dyes. Those cyanine dyes which contain basic nuclei such as thiazoline, oxazoline, pyrroline, pyridine, oxazole, thiazole, selenazole and imidazole nuclei are more preferred. Particularly, cyanine dyes containing imino groups or carboxy groups are effective. Merocyanine dyes may contain acidic nuclei such as thiohydantoin, rhodanine, oxazolizinedione, thiazolizinedione, barbituric acid, thiazolinone, malononitrile and pyrazolone nuclei, in addition to the above-described basic nuclei. Merocyanine dyes containing imino or carboxy groups are particularly effective. Specific examples of particularly effective sensitizing dyes for the thermally developable light-sensitive materials of the present invention include merocyanine dyes containing rhodanine, thiohydantoin or 2-thio-2,4-oxazolidinedione nuclei, e.g., as disclosed in U.S. Pat. No. 3,761, 279, Japanese Patent Application (OPI) No. 105127/75 and Japanese Patent Application (OPI) No. 104637/75.

Further, examples of other sensitizing dyes which may be employed in the present invention include trinuclear merocyanine dyes as disclosed in U.S. Pat. No. 3,719,495; sensitizing dyes mainly effective for silver iodide as disclosed in Japanese Patent Application (OPI) No. 17719/74; dyes of the styrylquinoline system as disclosed in British Patent No. 1,409,009; rhodacyanine dyes as disclosed in U.S. Pat. No. 3,877,943; acidic dyes such as 2', 7'-dichlorofluorescein dye as disclosed in Japanese Patent Application (OPI) Nos. 96717/74 and 102328/74, and British Patent No. 1,417,382; and merocyanine dyes as disclosed in Japanese Patent Application (OPI) Nos. 156424/75 and 101680/74.

A suitable amount of these sensitizing dyes is about $10^{-4}$ mol to about 1 mol per mol of the silver halide or the silver halide-forming component, component (b).

Suitable reducing agents, which are used as component (c) of the present invention, are those which are capable of reducing the organic silver salts used (component (a)) in the presence of the exposed photocatalyst, component (b), and preferably exposed silver halide, when the redox system is heated. The selection of the reducing agent to be employed depends upon the kinds and oxidizing ability of the organic silver salt with which it is used in combination.

Examples of reducing agents suitable for use include mono-, bis-, tris- or tetrakis-phenols; mono- or bis-naphthols; di- or poly-hydroxynaphthalenes; di- or poly-hydroxybenzenes; hydroxymonoethers; ascorbic acids; 3-pyrazolidones; pyrazolines; pyrazolones; reducing saccharides; phenylene-diamines; hydroxylamines; reductones; hydroxyoxaminic acids; hydrazides; and N-hydroxyureas. Specific examples of these reducing agents are described in detail in, e.g., Japanese Patent Application (OPI) No. 22431/76, U.S. Pat. Nos. 3,615,533, 3,679,426, 3,672,904, 3,751,252, 3,751,255, 3,782,949, 3,801,321, 3,794,488 and 3,893,863, Belgian Patent No. 786,086, U.S. Pat. Nos. 3,770,448, 3,819,382, 3,773,512, 3,928,686, 3,839,048 and 3,887,378, Japanese Patent Application (OPI) Nos. 15541/75 and 36143/75, U.S. Pat. No. 3,827,889, Japanese Patent Application (OPI) Nos. 36110/75, 116023/75, 147711/75 and 23721/76, and Japanese Patent Application Nos. 105290/74 and 126366/74.

Polyphenols, sulfonamidophenols and naphthols, of these compounds, are particularly preferred as reducing agents.

Preferred examples of polyphenols are 2,4-dialkyl-substituted orthobisphenols, 2,6-dialkyl-substituted parabisphenols or mixtures thereof. Specific examples of such compounds include 1,1-bis(2-hydroxy-3,5-dimethylphenyl)-3,5,5-trimethylhexane, 1,1-bis(2-hydroxy-3-t-butyl-5-methylphenyl)methane, 1,1-bis(2-hydroxy-3,5-di-t-butylphenyl)methane, 6-methylenebis(2-hydroxy-3-t-butyl-5-methylphenyl)-4-methylphenol, 6,6'-benzylidene-bis(2,4-di-t-butylphenol), 6,6'-benzylidene-bis(2-t-butyl-4-methylphenol), 6,6'-benzylidene-bis(2,4-dimethylphenol), 1,1-bis(2-hydroxy-3,5-dimethylphenyl)-2-methylpropane, 1,1,5,5-tetrakis(2-hydroxy-3,5-dimethylphenyl)-2,4-ethylpentane, 2,2-bis(4-hydroxy-3,5-dimethylphenyl)propane, 2,2-bis(4-hydroxy-3-methyl-5-t-butylphenyl)propane and 2,2-bis(4-hydroxy-3,5-di-t-butylphenyl)propane.

Preferred examples of naphthols include 2,2'-dihydroxy-1,1'-binaphthyl, 6,6'-dibromo-2,2'-dihydroxy-1,1'-binaphthyl, 6,6'-dinitro-2,2'-dihydroxy-1,1'-binaphthyl, bis(2-hydroxy-1-naphthyl)methane, 4,4'-dimethoxy-1,1'-dihydroxy-2,2'-binaphthyl and so on.

Preferred examples of sulfonamidophenols include 4-benzenesulfonamidophenol, 2-benzenesulfonamidophenol, 2,6-dichloro-4-benzenesulfonamidophenol and the like.

In addition to the above-described specific examples, more detailed examples are described in Japanese Patent Application (OPI) Nos. 22431/75, 36110/75, 116023/75, 147711/75 and 23721/76, Japanese Patent Applications 105290/75 and 126366/74, Japanese Patent Application (OPI) No. 15541/75, and U.S. Pat. Nos. 3,672,904 and 3,801,321.

In addition, colored images can be obtained when phenylenediamines are employed as a reducing agent and phenolic or active methylenic color couplers as disclosed in U.S. Pat. Nos. 3,531,286 and 3,764,328 are used in combination with the phenylenediamines. Similarly, colored images can be also obtained using the process as disclosed in U.S. Pat. No. 3,761,270.

Of these reducing agents, mono-, bis-, tris- or tetakisphenols having at least one alkyl group substituent, such as a methyl group, an ethyl group, propyl group, an isopropyl group or a butyl group, or an acyl group substituent at a position adjacent the position substituted with a hydroxy group, where the hydroxy group is connected to a carbon atom in the aromatic nucleus, for instance, a 2,6-di-t-butylphenol group, are particularly advantageous, since they are stable to light and, therefore, only a slight coloration at the background of the processed thermally developable light-sensitive materials occurs.

In addition, reducing agents of the kind which undergo photolysis and are rendered inert to light as disclosed in U.S. Pat. No. 3,827,889 are suitable for use, since coloration at the background of the processed thermally developable light-sensitive materials, which is caused by unreacted redox components gradually undergoing a redox reaction upon exposure to normal room illumination upon storage, can be prevented from occurring because of the decomposition or the inactivation of such reducing agents by light. Examples of photolytic reducing agents which can be used include ascorbic acid or derivatives thereof, furoin, benzoin, dihydroxyacetone, glyceraldehyde, tetrahydroxyquinone rhodizonate, 4-methoxy-1-naphthol and aromatic polysulfur compounds as disclosed in Japanese Patent Application (OPI) No. 99719/75. Direct positive images can be produced when thermally developable light-sensitive materials are prepared using reducing agents capable of undergoing photolysis and, then, are imagewise exposed to light to destroy the reducing agents. Further, photolysis-accelerating agents can be used in combination with such reducing agents, if desired.

A suitable reducing agent is selected from the abovedescribed reducing agents by taking into account the kind (ability) of the organic silver salt employed in combination therewith. For instance, reducing agents possessing strong reducing activity are suitable for use with silver salts which are comparatively difficult to reduce, such as silver benzotriazoles and silver behenate. On the other hand, for relatively easily reducible organic silver salts such as silver caprate and silver laurate, comparatively weak reducing agents are suitable. Specific examples of appropriate reducing agents for silver benzotriazole include 1-phenyl-3-pyrazolidones, ascorbic acid, ascorbic acid monocarboxylic acid esters, and naphthols such as 4-methoxy-1-naphthols. Suitable reducing agents for silver behenate are o-bisphenols of the bis(hydroxyphenyl)methane system, hydroquinone and other various kinds of reducing agents. Suitable examples of reducing agents for silver caprate and silver laurate are substituted tetrakisphenols, o-bisphenols of the bis(hydroxyphenyl)alkane system, p-bisphenols such as substituted compounds of bisphenol A and p-phenylphenol.

The simplest method for choosing a suitable reducing agent by one skilled in the art is by trial and error, wherein light-sensitive materials are prepared, e.g., as described in the examples hereinafter, and the photographic characteristics examined. The suitability or lack of suitability of the reducing agents used is determined by the results obtained.

The amount of the reducing agent employed will vary depending upon the kind of organic silver salt and the reducing agent used, and the presence of other additives. However, in general, amounts of about 0.05 to about 10 mol, and preferably about 0.1 to 3 mol, per mol of the organic silver salt is suitable.

The above-described, various types of reducing agents may be used alone or as a combination thereof, if desired.

A wide variety of known methods for preventing thermal fog from occurring, which often occurs in conventional thermally developable light-sensitive materials, can be also applied to the present invention. One method includes using mercury compounds, as disclosed in U.S. Pat. No. 3,589,903. Suitable mercury compounds include mercury bromide, mercury iodide and mercury acetate. In another method for preventing thermal fog, N-halo compounds including N-halosuccinic acid and N-haloacetamides, as disclosed in Japanese Patent Application (OPI) Nos. 10724/74, 97613/74, 90118/74 and 22431/76, are employed. In a further method for preventing thermal fog, compounds as disclosed in U.S. Pat. No. 3,885,968, Japanese Patent Application (OPI) Nos. 101019/75, 116024/75, 123331/75 and 134421/75, Japanese Patent Application Nos. 121631/74, 115781/74, 125037/74, 131827/74, 299/75, 28851/75 and 96155/75, for example, lithium salts, peroxides, persulfates, rhodium salts, cobalt salts, palladium salts, cerium compounds, sulfinic acids, thiosulfonic acids, disulfides, rosinic acid and acid polymers are employed. Of these compounds, sodium benzenesulfinate, sodium p-toluenesulfinate, sodium benzenethiosulfonate, cerium compounds such as cerium nitrate, cerium bromide, etc., palladium-acetylacetone complex, rhodiumacetylacetone complex and fatty acids are most advantageous. Other advantageous examples are described in Japanese Patent Application (OPI) No. 22431/76.

For the purpose of the prevention of coloration caused in thermally developable light-sensitive materials after they have been thermally developed (which is the phenomena that the unexposed areas of the thermally developed materials gradually change in color upon storage after thermal development through exposure to normal room illumination), various kinds of known effective compounds can be added to the thermally developable light-sensitive materials of the present invention. Examples of such compounds include precursors of stabilizers such as azole thioether and blocked azolethiones as disclosed in, for example, U.S. Pat. No. 3,839,041; tetrazolylthio compounds as disclosed in U.S. Pat. No. 3,700,457; light-sensitive halogen-containing organic oxidizing agents as disclosed in U.S. Pat. No. 3,707,377; halogen-containing compounds as disclosed in Japanese Patent Application (OPI) No. 119624/75 and U.S. Pat. No. 3,874,946; 1-carbamoyl-2-tetrazoline-5-thiones as disclosed in U.S. Pat. No. 3,893,859; and sulfur as disclosed in Japanese Patent Application (OPI) No. 26019/76.

In the present invention, components (a), (b), (c) and (d) are preferably dispersed into a binder and then coated on a support. On coating, three coating embodiments can be employed, namely, a single layer may be coated on a support using a dispersion prepared by dispersing all of the components into the same binder; two layers may be formed on a support by coating in sequence two kinds of dispersions (i.e., one dispersion containing components (a) and (b), and the other dispersion containing components (c) and (d); or one dispersion containing components (a), (b) and (c), and the other dispersion containing component (d); or one dispersion containing components (a), (b) and (d), and the other dispersion containing component (c)); or three layers may be coated in sequence on a support (for instance, the first layer contains components (a) and (b), the second layer contains component (c) and the third layer contains component (d)). Of course, various other combinations other than the above-described combinations may be prepared and multilayers may be formed on the support by coating them successively. It is, however, desirable for component (a) and component (b) to be incorporated in the same layer.

Each of the components of the present invention is dispersed into at least one kind of colloid employed as a binder. Advantageous binders, in general, are hydrophobic, but hydrophilic binders may be also used. Preferred binders are transparent or translucent. For instance, suitable binders include proteins such as gelatin, cellulose derivatives, polysaccharides such as dextran, natural products such as gum arabic and synthetic polymers. Preferred examples of binders are described in detail in Japanese Patent Application (OPI) No. 22431/76. Examples of particularly suitable binders are polyvinyl butyral, polyvinyl acetate, ethyl cellulose, polymethylmethacrylate, cellulose acetate butyrate, gelatin and polyvinyl alcohol. If desired, a combination of these binders can be used. A preferred weight ratio of the amount of binder to that of the orgnaic silver salt, component (a), ranges from about 10:1 to about 1:10 and, more particularly from about 4:1 to about 1:4.

The layers into which the components employed for the thermally developable light-sensitive materials of the present invention are incorporated, and other optional layers are provided on a support which can be selected from a wide variety of materials. Support materials which possess sufficient flexibility are preferred from the standpoint of their handling as information-recording materials, and they are ordinarily used in a form of a film, a sheet, a roll or a ribbon, although, in general, any shape may be employed.

Synthetic resin films, synthetic resin sheets, glass, wool, cotton, paper and metals such as aluminum are suitable materials for a support. Specific examples of suitable synthetic resin films include cellulose acetate films, polyester films, polyethylene terephthalate films polyamide films, polyimide films, cellulose triacetate films and polycarbonate films.

Furthermore, specific examples of paper supports include not only general papers but also photographic raw papers, papers for printing such as coated papers and art papers, baryta papers, resin-coated papers, water proof papers, papers sized with a polysaccharide or the like, as disclosed in Belgian Patent No. 784,615, papers containing a pigment such as titanium oxide or the like, papers coated with an $\alpha$-olefin polymer (e.g., polyethylene, polypropylene, ethylene-butene copolymers and the like) and papers pre-treated with polyvinyl alcohol.

When a paper is employed as a support, some or all of components (a), (b), (c) and (d), or some of or all of the additives can be incorporated into the support, if desired.

The thermally developable light-sensitive material of the present invention can also contain an antistatic layer an electrically conductive layer, a metal vacuum deposited layer, a subbing layer and a backing layer.

In addition, a top coated polymer layer can be optionally provided on the thermally developable lightsensitive layer with the intention of increasing the transparency of the thermally developable light-sensitive layer and of improving the heat resistance thereof. A suitable thickness of the top coat polymer layer ranges from about 1 micron to about 20 microns. Examples of polymers suitable for making the top coat layer include polyvinyl chloride, vinylidene chloride-vinyl chloride copolymer, polyvinyl acetate, vinyl chloride-vinyl acetate copolymer, polystyrene, methyl cellulose, ethyl cellulose, cellulose acetate butyrate, cellulose acetate, vinylidene chloride, polycarbonate, gelatin and polyvinyl alcohol.

Further, incorporating a carrier such as titanium oxide, kaolin, zinc oxide, silica, alumina, a polysaccharide such as starch or the like into the top coat polymer layer makes it possible for the top coat polymer layer to be written upon using stamp ink, a ball-point pen, a pencil or the like.

Optionally, various kinds of additives known in the art of making gelatin silver halide light-sensitive materials, for example, agents for antihalation, dyes for antihalation, whiteness-increasing dyes, filter dyes, light-absorbing materials, fluorescent whiteness-increasing agents, plasticizers, lubricants, surface active agents and hardeners, may be also employed in the thermally developable light-sensitive materials of the present invention. Further, matting agents such as calcium carbonate, starch, titanium dioxide, zinc oxide, silica, dextrin, barium sulfate, aluminum oxide, clay, diatomaceous earth, kaolin, etc., may be optionally added to the thermally developable light-sensitive materials of the present invention.

A process for preparing the thermally developable light-sensitive materials of the present invention is briefly summarized below. Organic silver salts are prepared by allowing organic silver salts-forming agents to react with silver ion-supplying agents such as silver nitrate using one of the processes hereinbefore described. The resulting organic silver salts are washed with water or alcohol and then dispersed into a binder for making an emulsion. The dispersion can be carried out using a colloid mill, a mixer, a ball-mill or a like means. To the thus-obtained polymer dispersion of the silver salts, a silver halide-forming agent is added to convert a portion of the organic silver salts into the corresponding silver halide. Instead of the addition of a silver halide-forming agent, previously prepared silver halides may be added to the polymer dispersion of the organic silver salts, or the organic silver salts and the silver halides may be prepared at the same time. Then, the various kinds of additives, such as sensitizing dyes, reducing agents and color toning agents, are added in turn in a form of, preferably, a solution. Thus, a coating composition is obtained when all of the additives have been added. This coating composition can be used as it is, without being evaporated to dryness. The coating composition is coated on an appropriate support to form a thermally developable light-sensitive layer. The top coat polymer layer, a subbing layer, a backing layer and other layers are provided on the respectively prescribed layers by coating, respectively, previously prepared coating solutions thereof in turn using various coating methods such as a dip coating method, an air knife coating method, a curtain coating method and a hopper coating method. If necessary, two or more layers may be coated simultaneously using methods as disclosed in U.S. Pat. No. 2,761,791 and British Patent No. 837,095.

If desired, prescribed patterns can be printed on the surface of or on the back of the support, or a layer provided on the support, to enable use as (season) tickets, post cards or other documents.

The thus-prepared thermally developable light-sensitive material is cut in strips having a size suitable for use and, then, image-wise exposed to light. The light-sensitive material can be optionally pre-heated to a temperature of about 80° C. to about 140° C. before exposure to light.

Examples of light sources suitable for the image-wise exposure include a tungsten lamp, a fluorescent lamp for copying which is employed mainly for exposure of diazo light-sensitive materials, a mercury lamp, an iodo lamp, a xenon lamp, a CRT light source, a laser light source and other various kinds of light sources. Not only line images such as drawings but also photographic images having a gradation can be used as an original. Alternatively, photographs of persons or landscapes can be taken using a camera. Contact printing, reflection printing or enlargement printing may be employed as the printing process. Light-sensitive materials with high sensitivity require an exposure of about 10 lux·sec., while those with low sensitivity require an exposure of about $10^4$ lux·sec. The thus image-wise exposed light-sensitive materials can be developed merely by heating (e.g., at a temperature of about 80 to about 180° C. and preferably about 100° C. to about 150° C.). The time necessary for heating can be arbitrarily controlled within the range of about 1 to 60 seconds. And the heating time, of course, depends upon the heating temperature used. The heating may be carried out by contacting the image-wise exposed light-sensitive material with a heated plate of a simple form or a heated drum, or by passing the image-wise exposed light-sensitive material through a heated space. The light-sensitive materials may be also heated using high frequency waves or laser beams. For the purpose of the prevention of an odor from being generated upon heating, an appropriate deodorant may be placed in the processing device. Alternatively, a certain perfume may be incorporated into the light-sensitive materials to mask such an odor.

The benzothiazines of the present invention are quite suitable as component (d) of thermally developable light-sensitive materials, since they do not sublime and since they exhibit a color-toning effect higher than that of known color toning agents at the same molar amount.

The thermally developable light-sensitive materials of the present invention do not undergo a deterioration in photographic characteristics (e.g., a deterioration in color tone, a reduction in sensitivity and so on) after storage for a long time under conditions of high temperature or/and high humidity, that is to say, they possess an excellent shelflife, due to the improved color toning agents employed therein.

The present invention is now illustrated in greater detail by reference to the following examples.

EXAMPLE 1

34 g of behenic acid was mixed with 500 ml of water and then, the mixture was heated to 85° C. in order to melt the behenic acid. While the mixture of behenic acid melted at 85° C. and the water was stirred with a stirrer (rotating at 1800 r.p.m.), a water solution of sodium hydroxide (2.0 g of sodium hydroxide and 50 ml of water) at 25° C. was added thereto over a 3 minute period to produce a mixture of sodium behenate and behenic acid and, further, stirring at 1800 r.p.m. was continued until the temperature of the resulting mixture decreased to 30° C. from 85° C.

Next, an aqueous solution of silver nitrate (8.5 g of silver nitrate and 50 ml of water) was added dropwise to the resulting mixture over a 3 minute period, while the mixture was stirred again. Stirring was continued for an additional 90 minutes. 200 ml of isoamyl acetate was added thereto to produce silver behenate particles. The collected silver behenate particles were dispersed into an isopropanol solution of polyvinyl butyral (25 g of polyvinyl butyral and 200 ml of isopropanol) using a homogenizer (under conditions of 25° C., at 3000 r.p.m. and for 30 minutes) to obtain a polymer dispersion of silver behenate.

Next, while the thus-obtained polymer dispersion of silver behenate was maintained at a temperature of 50° C. and stirred at 500 r.p.m., an acetone solution of N-bromosuccinimide prepared at 25° C. (0.7 g of N-bromosuccinimide and 50 ml of acetone) was added thereto. The resulting mixture was further stirred for 60 minutes. Thus, a polymer dispersion of silver bromide and silver behenate was obtained.

A 1/12 portion (1/240 mol) of the thus-obtained silver bromide-silver behenate polymer dispersion was withdrawn and maintained at a temperature of 30° C. While the dispersion was stirred with a stirrer (rotating at 200 r.p.m.), the following components were added thereto every 5 minutes in the order listed below to prepare a coating composition (A).

| | | |
|---|---|---|
| (i) | Merocyanine Dye * (sensitizing dye) (0.025% by weight methyl Cellosolve solution) | 2 ml |
| (ii) | Sodium Benzenethiosulfonate (0.02% by weight methanol solution) | 4 ml |
| (iii) | Color Toning Agent (Component (d)) 2H-1,3-benzothiazin-2,4(3H)-dione (Compound (1)) (1.5% by weight methyl Cellosolve solution) | 5 ml |
| (iv) | o-Bisphenol ** (reducing agent) (10% by weight acetone solution) | 10 ml |

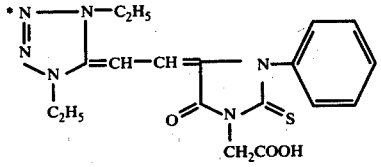

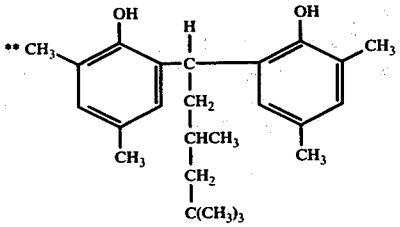

For the purpose of comparison, a coating composition (B) was prepared in the same manner as coating composition (A) except that the same molar amount of phthalazinone was used as component (iii) instead of Compound (1) of the present invention.

In addition, a coating composition (C) was prepared in the same manner as coating composition (A) except that 5 ml of a 4.5% by weight methyl Cellosolve solution of phthalazinone was used in combination with the above-described component (iii) as a color toning agent.

Each of the thus-prepared three coating compositions was coated on a support (raw paper for a pressure sensitive copying paper having a subbing layer of polyvinyl alcohol) at a coverage of 0.3 g of silver per square meter to obtain thermally developable Light-Sensitive Materials (A-1), (B-1) and (C-1), respectively.

Further, for the purpose of comparison, a thermally developable Light-Sensitive Material (D) was prepared in the same manner as thermally developable Light-Sensitive Material (A-1) except that 5 ml of a 5% by weight methyl Cellosolve solution of phthalimide was used as a known color toning agent instead of a 2H-1,3-benzothiazin-2,4(3H)-dione.

For the further purpose of comparison, a thermally developable Light-Sensitive Material (E) was prepared in the same manner as thermally developable Light-Sensitive Material (A-1) except that 5 ml of a 1.5% by weight methyl Cellosolve solution of benzoxazinedione was used as a known color toning agent corresponding to the above described component (iii) instead of 2H-1,3-benzothiazin-2,4(3H)-dione.

Each of the thus-obtained thermally developable Light-Sensitive Materials (A-1), (B-1), (C-1), (D) and (E) was wedgewise exposed to light using a tungsten lamp (maximum intensity of exposure: 3,000 CMS). Then, they were developed by heating at a temperature of 130° C. for 8 seconds by contacting the light-sensitive materials with a hot plate.

On the other hand, thermally developable Light-Sensitive Materials (A-1), (B-1), (C-1), (D) and (E) were allowed to stand for 5 days under conditions of a relative humidity of 80% and a temperature of 35° C. (hereinafter called forced deterioration). Each of the resulting materials was exposed to light and thermally developed under the above-described conditions. The color tones and sensitivities exhibited by these samples are shown in Table 1 below.

TABLE 1

| Light-Sensitive Material | Before Forced Deterioration | | | | After Forced Deterioration | | | |
|---|---|---|---|---|---|---|---|---|
| | Color Tone** | Relative Sensitivity* | Dmax | Dmin (fog) | Color Tone** | Relative Sensitivity* | Dmax | Dmin (fog) |
| A-1 | 8 | 80 | 1.25 | 0.25 | 8 | 80 | 1.05 | 0.20 |
| B-1 | 10 | 100 | 1.30 | 0.15 | 1 | 20 | 0.30 | 0.05 |
| C-1 | 10 | 150 | 1.35 | 0.30 | 9 | 80 | 1.15 | 0.20 |
| D | 4 | 60 | 0.60 | 0.12 | 3 | 30 | 0.45 | 0.07 |
| E | 6 | 20 | 0.75 | 0.25 | 5 | 10 | 0.65 | 0.20 |

*The relative sensitivity was determined by taking as 100 the reciprocal of the quantity of exposure necessary to provide a density of fog + 0.1 in Light-Sensitive Material (B-1) in a fresh condition.
**Evaluation determined by taking a pure black tone as a grade of 10 and a yellow tone (which is obtained when no color toning agent is present) as a grade of 1.

It can be seen from the results in Table 1 that thermally developable Light-Sensitive Materials (A-1) and (C-1) of the present invention showed a small drop in sensitivity and that both color tone and image density exhibited by each of them could be maintained to a large extent, that is to say, they exhibited excellent shelf life compared with thermally developable Light-Sensitive Materials (B-1), (D) and (E) which contained known color toning agents, i.e., phthalazinone alone, phthalimide alone and benzoxazinedione alone, respectively.

EXAMPLE 2

Thermally developable Light-Sensitive Materials (A-2), (B-2) and (C-2) each was prepared in the same manner as in Example 1 except that 5 ml of a 1.5% by weight methyl Cellosolve solution of 6-methyl-2H-1,3-benzothiazin-2,4(3H)-dione (Compound (10)) was used as a color toning agent instead of using 2H-1,3-benzothiazin-2,4(3H)-dione (Compound (1)). They were processed in the same manner as in Example 1. The results obtained are shown in Table 2 below.

TABLE 2

| Light-Sensitive Material | Before Forced Deterioration | | | | After Forced Deterioration | | | |
|---|---|---|---|---|---|---|---|---|
| | Color Tone** | Relative Sensitivity* | Dmax | Dmin (fog) | Color Tone** | Relative Sensitivity* | Dmax | Dmin (fog) |
| A-2 | 8 | 90 | 1.30 | 0.30 | 8 | 85 | 1.10 | 0.25 |
| B-2 | 10 | 100 | 1.30 | 0.15 | 1 | 20 | 0.30 | 0.05 |
| C-2 | 10 | 170 | 1.35 | 0.35 | 9 | 85 | 1.15 | 0.25 |

* and ** as described in Table 1 (B-2 used as standard)

EXAMPLE 3

Thermally developable Light-Sensitive Materials (A-3), (B-3) and (C-3) each was prepared in the same manner as in Example 1 except that 5 ml of a 1.5% by weight methyl Cellosolve solution of 6-bromo-2H-1,3-benzothiazin-2,4(3H)-dione (Compound (5)) was used as a color toning agent instead of using 2H-1,3-benzothiazin-2,4(3H)-dione (Compound (1)). Each of these materials was processed in the same manner as in Example 1. The results obtained are shown in Table 3 below.

TABLE 3

| Light Sensitive Material | Before Forced Deterioration | | | | After Forced Deterioration | | | |
|---|---|---|---|---|---|---|---|---|
| | Color Tone** | Relative Sensitivity* | Dmax | Dmin (fog) | Color Tone** | Relative Sensitivity* | Dmax | Dmin (fog) |
| A-3 | 8 | 60 | 1.15 | 0.17 | 8 | 60 | 1.00 | 0.13 |
| B-3 | 10 | 100 | 1.30 | 0.15 | 1 | 20 | 0.30 | 0.05 |
| C-3 | 10 | 110 | 1.30 | 0.20 | 10 | 60 | 1.10 | 0.14 |

*and ** as described in Table 1 (B-3 used as standard)

EXAMPLE 4

Thermally developable Light-Sensitive Materials (A-4), (B-4) and (C-4) each was prepared in the same manner as in Example 1 except that 5 ml of a 1.5% by weight methyl Cellosolve solution of 6,8-dibromo-2H-1,3-benzothiazin-2,4(3H)-dione (Compound (6)) was used as a color toning agent instead of using 2H-1,3-benzothiazin-2,4(3H)-dione (Compound (1)). Each of the materials was processed in the same manner as in Example 1. The results obtained are shown in Table 4 below.

TABLE 4

| Light-Sensitive Material | Before Forced Deterioration | | | | After Forced Deterioration | | | |
|---|---|---|---|---|---|---|---|---|
| | Color Tone** | Relative Sensitivity* | Dmax | Dmin (fog) | Color Tone** | Relative Sensitivity* | Dmax | Dmin (fog) |
| A-4 | 8 | 50 | 1.10 | 0.12 | 8 | 40 | 1.00 | 0.10 |
| B-4 | 10 | 100 | 1.30 | 0.15 | 1 | 20 | 0.30 | 0.05 |
| C-4 | 10 | 105 | 1.25 | 0.14 | 10 | 50 | 1.05 | 0.11 |

*and ** as described in Table 1 (B-4 taken as standard)

EXAMPLE 5

Thermally developable Light-Sensitive Materials (A-5), (B-5) and (C-5) each was prepared in the same manner as in Example 1 except that 5 ml of a 1.5% by weight methyl Cellosolve solution of 6-(t)-butyl-2H-1,3-benzothiazin-2,4(3H)-dione (Compound (15)) was used as a color toning agent instead of using 2H-1,3-benzothiazin-2,4(3H)-dione (Compound (1)). Each of the materials was processed in the same manner as in Example 1. The results obtained are shown in Table 5 below.

TABLE %

| Light-Sensitive Material | Before Forced Deterioration | | | | After Forced Deterioration | | | |
|---|---|---|---|---|---|---|---|---|
| | Color Tone** | Relative Sensitivity* | Dmax | Dmin (fog) | Color Tone** | Relative Sensitivity* | Dmax | Dmin (fog) |
| A-5 | 8 | 95 | 1.30 | 0.20 | 8 | 90 | 1.15 | 0.23 |
| B-5 | 10 | 100 | 1.30 | 0.15 | 1 | 20 | 0.30 | 0.05 |
| C-5 | 10 | 180 | 1.35 | 0.32 | 10 | 95 | 1.20 | 0.25 |

*and ** as described in Table 1 (B-5 taken as standard)

While the invention has been described in detail and with reference to specific embodiments thereof, it will be apparent to one skilled in the art that various changes and modifications can be made therein without departing from the spirit and scope thereof.

What is claimed is:

1. A thermally developable light-sensitive material comprising a support and containing at least (a) an organic silver salt, (b) a photocatalyst, (c) a reducing agent and (d) at least one 2H-1,3-benzothiazin-2,4(3H)-dione, as a color toning agent, in the support or in at least one layer on the support.

2. The thermally developable light-sensitive material as described in claim 1, wherein said 2H-1,3-benzothiazin-2,4(3H)-dione (d) is at least one compound represented by the following general formula (I):

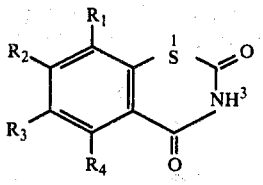

(I)

wherein $R_1$, $R_2$, $R_3$ and $R_4$, which may be the same or different, each represents a hydrogen atom, a halogen atom, an alkyl group, a cycloalkyl group, an aryl group, an alkoxy group, an aryloxy group, an alkylthio group, an arylthio group, a hydroxy group, an acyloxy group, a nitro group, an amino group, an alkyl-substituted amino group, an aryl-substituted amino group, an acylamino group, an acyl group, a hydroxycarbonyl group, an alkoxycarbonyl group, an aryloxycarbonyl group, a sulfamoyl group, an alkyl-substituted sulfamoyl group, an aryl-substituted sulfamoyl group, an alkoxy-substituted sulfamoyl group, an alkylsulfonyl group, an arylsulfonyl group or a sulfo group, further, $R_1$ and $R_2$, $R_2$ and $R_3$, and/or $R_3$ and $R_4$, may combine and represent the atoms necessary to form a condensed aromatic ring; and, further, one of $R_1$, $R_2$, $R_3$ and $R_4$ may be a monovalent residue of the general formula (I).

3. The thermally developable light-sensitive material as described in claim 2, wherein said $R_1$, $R_2$, $R_3$ and $R_4$, which may be the same or different, each represents a hydrogen atom, a halogen atom, an alkyl group, a cycloalkyl group, an aryl group, an alkoxy group, an aryloxy group, an alkylthio group, an arylthio group, a hydroxy group, an acyloxy group, a nitro group, an acylamino group, an acyl group, an alkoxycarbonyl group, an aryloxycarbonyl group, a sulfamoyl group, an alkyl-substituted sulfamoyl group, an aryl-substituted sulfamoyl group, an alkoxy-substituted sulfamoyl group, an alkylsulfonyl group or an arylsulfonyl group.

4. The thermally developable light-sensitive material as described in claim 2, wherein, for $R_1$, $R_2$, $R_3$ and $R_4$, said halogen atom is a fluorine atom, a chlorine atom, a bromine atom or an iodine atom; said alkyl group is an alkyl group which may be straight chain or branched chain and which contains 1 to 20 carbon atoms; said cycloalkyl group is a cycloalkyl group which contains 5 to 8 carbon atoms; said aryl group is a monocyclic or bicyclic aryl group containing 6 to 14 carbon atoms; said alkoxy group is an alkoxy group containing a straight chain, branched chain or cyclic alkyl moiety containing up to 12 carbon atoms; said aryloxy group is an aryloxy group containing a monocyclic or bicyclic aryl moiety containing 6 to 14 carbon atoms; said alkylthio group is an alkylthio group containing a straight chain, branched chain or cyclic alkyl moiety containing up to 20 carbon atoms; said arylthio group is an arylthio group containing a monocyclic or bicyclic aryl moiety containing 6 to 14 carbon atoms; said acyloxy group is an acyloxy group containing a straight chain, branched chain or cyclic alkyl moiety containing up to 20 carbon atoms, a straight chain, branched chain or cyclic alkenyl moiety containing up to 20 carbon atoms or a monocyclic or bicyclic aryl moiety containing 6 to 14 carbon atom; said alkyl-substituted amino group is a mono- or di-substituted amino group in which the alkyl moiety is a straight chain, branched chain or cyclic alkyl moiety containing up to 12 carbon atoms; said aryl-substituted amino group is a mono- or di-substituted amino group in which the aryl moiety is a monocyclic or bicyclic aryl moiety containing 6 to 14 carbon atoms; said acylamino group is a mono- or di-substituted amino group in which the acyl moiety thereof contains a straight chain, branched chain or cyclic alkyl moiety containing up to 20 carbon atoms, a straight chain, branched chain or cyclic alkenyl moiety containing up to 20 carbon atoms or a monocyclic or bicyclic aryl moiety containing 6 to 14 carbon atoms; said acyl group is an acyl group containing a straight chain, branched chain or cyclic alkyl moiety containing up to 11 carbon atoms, a straight chain or branched chain alkenyl moiety containing up to 20 carbon atoms or a monocyclic or bicyclic aryl moiety containing 6 to 14 carbon atoms; said alkoxycarbonyl group is an alkoxycarbonyl group containing a straight chain, branched chain or cyclic alkyl moiety therein containing up to 20 carbon atoms; said aryloxycarbonyl group is an aryloxycarbonyl group containing a monocyclic or bicyclic aryl moiety containing 6 to 14 carbon atoms; said alkyl-substituted sulfamoyl group is a mono-substituted or di-substituted sulfamoyl group in which the alkyl moiety is a straight chain, branched; chain or cyclic alkyl moiety containing up to 12 carbon atoms; said alkoxy-substituted sulfamoyl group is a mono- or -di-substituted sulfamoyl group in which the alkoxy moiety contains a straight chain, branched chain or cyclic alkyl moiety having up to 12 carbon atoms; said aryl-substituted sulfamoyl group is a mono- or -di-substituted sulfamoyl group in which the aryl moiety is a monocyclic or bicyclic aryl moiety having 6 to 14 carbon atoms; said alkyl-sulfonyl group is a sulfonyl group containing a straight chain, branched chain or cyclic alkyl moiety containing up to 20 carbon atoms; said arylsulfonyl group is a sulfonyl group substituted with a monycyclic or bicyclic aryl moiety containing 6 to 14 carbon atoms; and wherein said alkyl group, said cycloalkyl group, said aryl group, said alkoxy group, said aryloxy group, said alkylthio group, said arylthio group, said acyloxy group, said alkyl-substituted amino group, said aryl-substituted amino group, said acylamino group, said acyl group, said alkoxycarbonyl group, said aryloxycarbonyl group, said alkyl-substituted sulfamoyl group, said alkoxy-substituted sulfamoyl group, said aryl-substituted sulfamoyl group, said alkylsulfonyl group and said arylsulfonyl group may be additionally substituted with one or more of a halogen atom, a nitro group, an alkoxy group containing 1 to 5 carbon atoms, an acyl group containing 1 to 5 carbon atoms, an acyloxy group containing 2 to 5 carbon atoms, a carboxy group, an alkoxycarbonyl group containing 2 to 5 carbon atoms, an aryl group which may be substituted with one or more of a halogen atom, an alkyl group having 1 to 4 carbon atoms or an alkoxy group having 1 to 4 carbon atoms, an aryloxy group containing 6 to 14 carbon atoms which may be further substituted with one or more of a halogen atom, an alkyl group having 1 to 4 carbon atoms or an alkoxy group having 1 to 4 carbon atoms; and wherein when $R_1$ and $R_2$, $R_2$ and $R_3$, and/or $R_3$ and $R_4$ combine to form a ring, said ring is a benzene ring.

5. The thermally developable light-sensitive material as described in claim 1, wherein said 2H-1,3-benzothiazin-2,4(3H)-dione (d) is 2H-1,3-benzothiazin-2,4(3H)-dione, 8-chloro-2H-1,3-benzothiazin-2,4(3H)-dione, 6,8-dichloro-2H-1,3-benzothiazin-2,4(3H)-dione, 6-chloro-8-bromo-2H-1,3-benzothiazin-2,4(3H)-dione, 6-bromo-2H-1,3-benzothiazin-2,4(3H)-dione, 6,8-dibromo-2H-1,3-benzothiazin-2,4(3H)-dione, 6-iodo-2H-1,3-benzothiazin-2,4(3H)-dione, 6,8diiodo-2H-1,3-benzothiazin- 2,4(3H)-dione or 6-fluoro-2H-1,3-benzothiazin-2,4(3H)-dione.

6. The thermally developable light-sensitive material as described in claim 1, wherein said 2H-1,3-benzothiazin-2,4(3H)-dione (d) is 6-methyl-2H-1,3-benzothiazin-2,4(3H)-dione, 8-methyl-2H-1,3-benzothiazin-2,4(3H)-dione, 6,7-dimethyl-2H-1,3-benzothiazin-2,4(3H)-dione, 6-(t)-butyl-2H-1,3-benzothiazin-2,4(3H)-dione or 6,8-di-(t)-butyl-2H-1,3-benzothiazin-2,4(3H)-dione.

7. The thermally developable light-sensitive material as described in Claim 1, wherein said 2H-1,3-benzothiazin-2,4(3H)-dione (d) is 6-phenyl-2H-1,3-benzothiazin-2,4(3H)-dione.

8. The thermally developable light sensitive material as described in claim 1, wherein said 2H-1,3-benzothiazin-2,4(3H)-dione (d) is 6-methylthio-2H-1,3-benzothiazin-2,4(3H)-dione, 6-methylthio-7-methyl-2H-1,3-benzothiazin-2,4(3H)-dione or 6-phenylthio-2H-1,3-benzothiazin-2,4(3H)-dione.

9. The thermally developable light-sensitive material as described in claim 1, wherein said 2H-1,3-benzothiazin-2,4(3H)-dione (d) is 6-nitro-2H-1,3-benzothiazin-2,4(3H)-dione or 6,8-dinitro-2H-1,3-benzothiazin-2,4(3H)-dione.

10. The thermally developable light-sensitive material as described in claim 1, wherein said 2H-1,3-benzothiazin-2,4(3H)-dione (d) is 6-acetylamino-2H-1,3-benzothiazin-2,4(3H)-dione.

11. The thermally developable light-sensitive material as described in claim 1, wherein said 2H-1,3-benzothiazin-2,4(3H)-dione (d) is 6-acetylamino-2H-1,3-benzothiazin-2,4(3H)-dione, 6-acetyl-2H-1,3-benzothiazin-2,4(3H)-dione, 6-benzoyl-2H-1,3-benzothiazin-2,4(3H)-dione or 6-(2,4-dihydroxyphenyl)carbonyl-2H-1,3-benzothiazin-2,4(3H)-dione.

12. The thermally developable light-sensitive material as described in cliam 1, wherein said 2H-1,3-benzothiazin-2,4(3H)-dione (d) is 6-carboxy-2H-1,3-benzothiazin-2,4(3H)-dione.

13. The thermally developable light-sensitive material as described in claim 1, wherein said 2H-1,3-benzothiazin-2,4(3H)-dione (d) is 6-ethoxycarbonyl-2H-1,3-benzothiazin-2,4(3H)-dione or 6-phenoxycarbonyl-2H-1,3-benzothiazin-2,4(3H)-dione.

14. The thermally developable light-sensitive material as described in claim 1, wherein said 2H-1,3-benzothiazin-2,4(3H)-dione (d) is 6-methylsulfamoyl-7-chloro-2H-1,3-benzothiazin-2,4(3H)-dione or 6-phenylsulfamoyl-7-chloro-2H-1,3-benzothiazin-2,4(3H)-dione.

15. The thermally developable light-sensitive material as described in claim 1, wherein said 2H-1,3-benzothiazin-2,4(3H)-dione (d) is 6-benzylsulfonyl-2H-1,3-benzothiazin-2,4(3H)-dione or 6-methylsulfonyl-1,3-benzothiazin-2,4(3H)-dione.

16. The thermally developable light-sensitive material as described in claim 1, wherein said 2H-1,3-benzothiazin-2,4(3H)-dione (d) is present in an amount of about $10^{-4}$ to 10 mol per mol of said organic silver salt (a).

17. The thermally developable light-sensitive material as described in claim 1, wherein said 2H-1,3-benzothiazin-2,4(3H)-dione (d) is present in an amount of about 0.01 to 2 mol per mole of said organic silver salt (a).

18. The thermally developable light-sensitive material as described in claim 1, wherein said thermally developable light-sensitive material additionally contains a binder.

19. The thermally developable light-sensitive material as described in claim 18, wherein said binder is polyvinyl butyral.

20. The thermally developable light-sensitive material as described in claim 1, wherein said photocatalyst (b) is a silver halide.

21. The thermally developable light-sensitive material as described in claim 20, wherein said silver halide is produced in situ by reaction of said organic silver salt with an N-halo compound.

22. The thermally developable light-sensitive material as described in claim 1, wherein said photocatalyst (b) is present in an amount of about 0.001 to about 0.7 mol per mol of said organic silver salt (a).

23. The thermally developable light-sensitive material as described in claim 1, wherein said organic silver salt (a) is a silver salt of a straight chain aliphatic carboxylic acid having 10 to 40 carbon atoms.

24. The thermally developable light-sensitive material as described in claim 1, wherein said reducing agent (c) is a polyphenol, a sulfonamidophenol or a naphthol.

25. The thermally developable light-sensitive material as described in claim 24, wherein said reducing agent (c) is a 2,4-dialkyl-substituted o-bisphenol or a 2,6-dialkyl-substituted p-bisphenol.

26. The thermally developable light-sensitive material as described in claim 1, wherein said reducing agent (c) is present in an amount of about 0.05 to about 10 mol per mol of said organic silver salt (a).

27. The thermally developable light-sensitive material as described in claim 1, wherein said thermally developable light-sensitive material additionally contains a sensitizing dye.

28. The thermally developable light-sensitive material as described in claim 1, wherein said thermally developable light-sensitive material additionally contains an anti-heat foggant.

29. The thermally developable light-sensitive material as described in claim 28, wherein said anti-heat foggant is sodium benzenesulfinate.

30. The thermally developable light-sensitive material as described in claim 1, wherein said thermally developable light-sensitive material additionally contains an auxiliary color toning agent selected from the group consisting of phthaladinone, phthaladinone derivatives, a benzoxazinedione, a phthalimide, a succinimide and a 2,4-thiazolidinedione.

31. The thermally developable light-sensitive material as described in claim 30, wherein said auxiliary color toning agent is a phthaladinone.

32. The thermally developable light-sensitive material as described in claim 30, wherein said auxiliary color toning agent is 6-bromo-1,3-benzoxazine-2,4(3H)-dione, 7-bromo-1,3-benzoxazine-2,3(3H)-dione or 4-bromophthaladinone.

33. The thermally developable light-sensitive material as described in claim 30, wherein said auxiliary color toning agent is present in an amount of 50 mol or less per mol of said 2H-1,3-benzothiazin-2,4(3H)-dione.

* * * * *